US008534861B2

(12) United States Patent
Leegate et al.

(10) Patent No.: US 8,534,861 B2
(45) Date of Patent: Sep. 17, 2013

(54) MOUNTABLE MULTI-FUNCTION MULTI-MODE MARKER/SIGNALING DEVICE

(76) Inventors: Gary Leegate, Clearwater, FL (US); Marcia Baldwin, Clearwater, FL (US)

( * ) Notice: Subject to any disclaimer, the term of this patent is extended or adjusted under 35 U.S.C. 154(b) by 74 days.

(21) Appl. No.: 13/346,825

(22) Filed: Jan. 10, 2012

(65) Prior Publication Data

US 2013/0176714 A1 Jul. 11, 2013

(51) Int. Cl.
*F21V 21/084* (2006.01)

(52) U.S. Cl.
USPC ..... 362/105; 362/103; 362/106; 362/107; 362/109

(58) Field of Classification Search
USPC ..... 362/103–120
See application file for complete search history.

(56) References Cited

U.S. PATENT DOCUMENTS 6,752,510 B1 6/2004 Appiah
7,722,205 B2 * 5/2010 Kim ..... 362/106
8,220,950 B1 * 7/2012 Sunshine ..... 362/109
2009/0058575 A1 * 3/2009 Pizzuto ..... 335/78
2009/0303698 A1 * 12/2009 Huss et al. ..... 362/105
2010/0202135 A1 8/2010 Kim
2011/0249432 A1 10/2011 Swan et al.

* cited by examiner

*Primary Examiner* — William Carter
(74) *Attorney, Agent, or Firm* — Thomas Frost

(57) ABSTRACT

A multi-mode, multi-function marker/signaling device, capable of detachably mounting to helmets, has operating switches with positive visual and tactile cues located at opposing ends. A cover is attached to a base to provide a waterproof internal space. An electronic circuit board mounted within the waterproof space includes one or more visible and/or infrared emitters. Built-in programming provides user-defined and selectable modes of operation and multiple functions within those modes by means of serial manipulation of each switching means with a single digit. The emitters are multi-colored and/or infrared devices operating either steady ON, flashing, or coded flash, and are programmed to operate either independently or together. A replaceable battery provides power. A battery compartment is integral to and accessed from the underside (mounting surface) of the base.

9 Claims, 7 Drawing Sheets

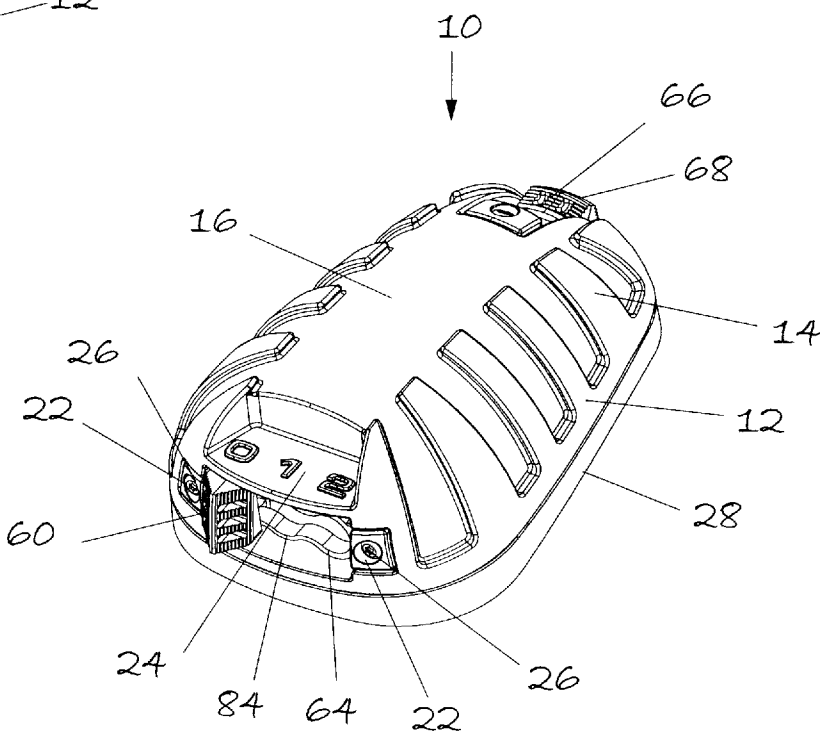
FIG 1b
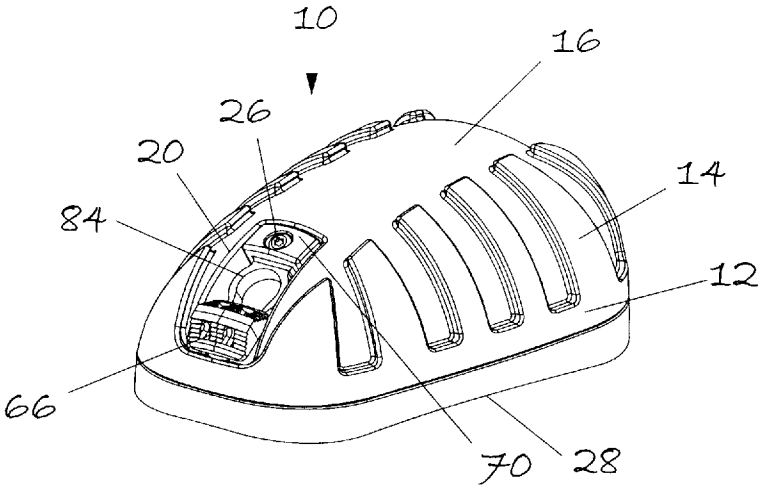
FIG 1a
FIGS. 1a - 1b

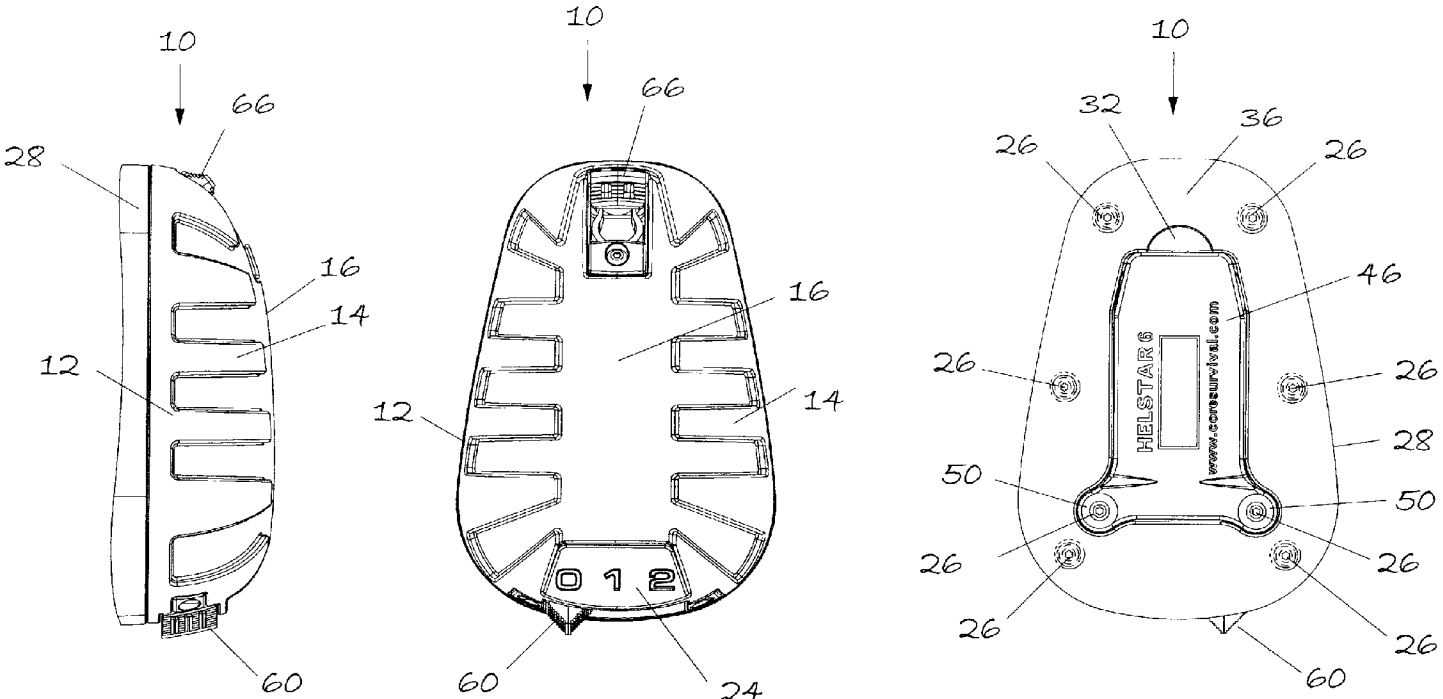
FIG. 2a
FIG. 2b
FIG. 2c
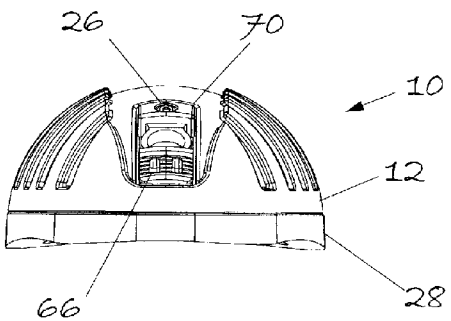
FIG. 2d
FIG. 2e

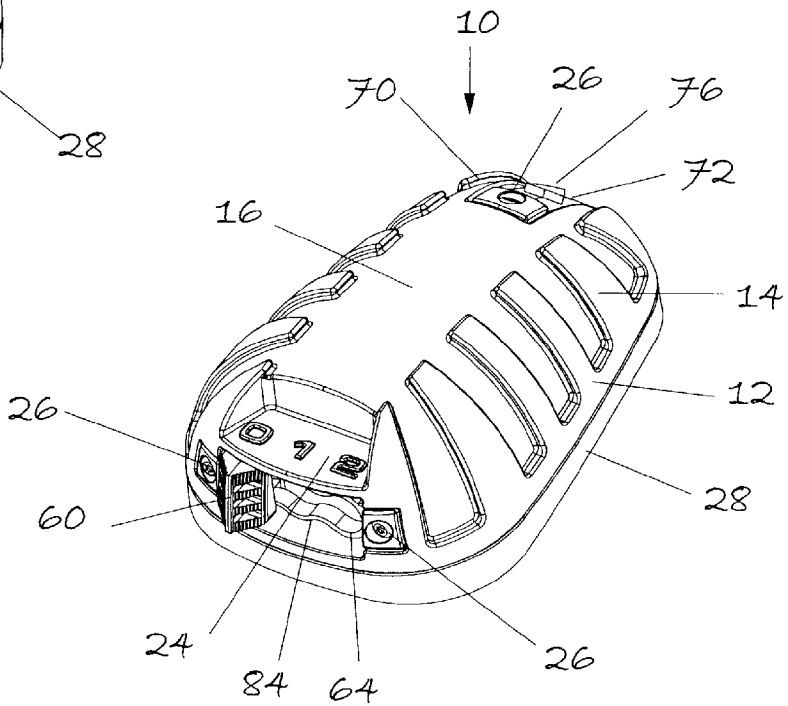
FIG 3b
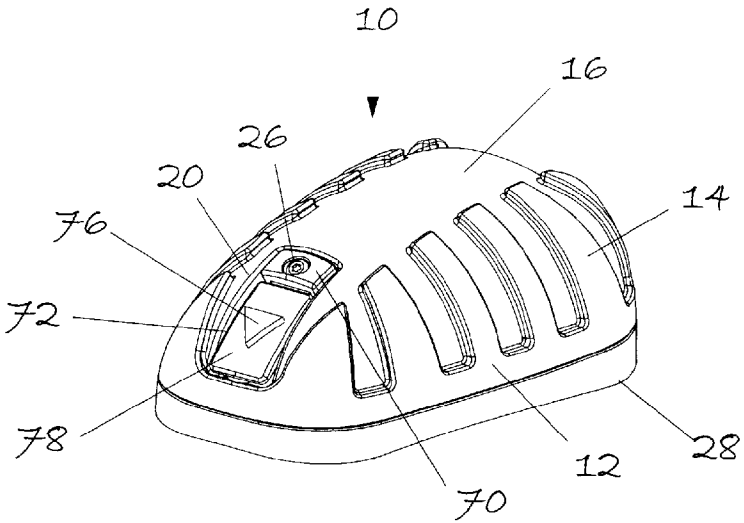
FIG 3a
FIGS. 3a - 3b

MOUNTABLE MULTI-FUNCTION MULTI-MODE MARKER/SIGNALING DEVICE

BACKGROUND OF INVENTION

The present invention relates to a multi-function, multi-mode marker/signaling device in the visible and/or infrared spectrum with steady, flash and/or coded flash signals for marking or identification purposes in low/no light conditions.

The device is multi-modal, and multi-functional with single or dual user-selectable operating modes, with two or more distinct operating functions within each operating mode. Visible and invisible (infrared) marking is provided by multi-colored light emitting diodes (LED) or infrared (IR) emitters (emitters). Each distinct function can be varied with respect to output in the visible spectrum (visible) or infrared (IR), with respect to combinations of visible and/or IR emissions, and with respect to variable intensities, and can be positioned in either a steady ON or flash-coded mode for marking or identification in the low/no light conditions. It is designed for detachably mounting onto the top, back, front, or sides of helmets as a signal marking identification, position, or location, and for collision avoidance by parachutists during night jumps in free fall or under canopy. It can also be adapted to mount on other gear, vehicles or structures as the military missions or other uses dictate.

It is an object of the invention to provide both a visual and tactile (touch) means of determining and verifying ON/OFF, and operating mode, and functional operating status of the device that is positive, unambiguous and constantly available, without having to rely on passive, transitory vibratory feedback that can be masked in a high noise, high vibration environment or confused or forgotten. The positive and constantly available visual and tactile (touch) verification means also helps to preclude battery depletion if the device were to be inadvertently left ON in an invisible, infrared (IR) operating mode.

It is an another object of the invention to provide low profile housing with a curved, minimally obstructive shape on all sides and edges to mount on helmets or other equipment or structures, and particularly to provide minimal snag potential or interference with objects that may be encountered including parachute lines and risers during parachute operations.

It is another object of the invention to provide a device that offers a low force, passive emergency breakaway, detachability feature to prevent head or neck injury to the wearer in the event that the device should interfere with parachute lines or risers during deployment of the parachute or interference with other obstacles.

It is another object of the invention to provide a low profile and shaped design on all sides and edges with no substantial protuberances violating the curvilinear dome-like external shape of the device in order to provide a low wind resistance shape which does not create wind-rush noise or significant additional wind loads on the head and neck of a parachutist during the high speed free fall segment of some parachute missions.

It is another object of the invention is to provide combinations of two, three, four or more different user-defined and selectable functions within one or two user-defined, selectable, and independent operating modes and in a single device allowing users to acquire only one specific device to be used for multiple and distinct mission requirements such as tactical and training operations.

It is another object of the invention to provide the ability to select between two distinct and independent operating modes with two or more discreet functions within each operating mode, and to effectively separate and segregate these independent sets of functions by mechanical switching means whose relative position and therefore, operating status, are confirmable by two positive, unambiguous, and constantly available methods, e.g, visual and tactile (touch), to facilitate use of the same device in different mission environments such as training (e.g., non-secure visible emissions) and tactical (e.g., secure, infrared/IR emissions). This feature is novel in comparison to other lighting devices purpose-built for helmet mounting including those with rotating ring switches, opposed simultaneously activated pressure switches, and push-button ON/OFF switches where there may be no positive, unambiguous and constantly available visual and tactile (touch) means of confirming operating status.

It is another object of the invention to provide a variety of emitters to allow a user-defined selection of different signaling outputs in the visible and/or infrared spectrum.

It is another object of the invention to provide two mechanically similar, interactive, but independent emitter activation switch means which comprise mechanically sliding switch(es) and/or repositionable magnetic/reed switch/plug arrangements for function and/or operating mode selection. This feature is novel in comparison to other lighting devices purpose-built for helmet mounting that may use in combination two or more dissimilar and potentially confusing switching means.

It is another object of this invention to provide a function-selection switch means which allows for the selection of two or more functions within one or two user-defined and selectable operating modes.

It is another object of the invention to provide a mode-selection switch means to allow a user, in the field, to have the ability to change to or select from one set of two or more functions to another set of two or more functions, in the same device, without tools or programming, and to make such switching means independent of one another to the extent that one or the other mode of operation (such as overt/visible versus covert/infrared may be selected without dependence upon first being in one or the other mode.

It is another object of the invention to provide one or more switching means which can be activated single-handedly, in total darkness and/or outside of direct visual contact, with a single digit (thumb or finger) precluding the necessity for the simultaneous use of multiple digits (e.g., thumb and finger) to turn a rotating ring or simultaneously press multiple switches to invoke any operating function.

It is another object of this invention to provide a dual purpose switch means retainer providing the ability to accommodate either (a) a sliding magnetic/reed switch arrangement which allows for the two sets of functions to be switchable by the user at will, or (b) a more secure repositionable, snap-in magnet switch/plug which requires pre-selection of a specific set of functions thereby helping to prevent inadvertent activation of an undesirable set of functions under a given mission environment.

It is another object of the invention to provide a battery compartment with access arrayed on the bottom or mounting interface surface of the device by which access to battery is protected and secured in the interface between the invention and the helmet or structure to which is it mounted and which is separately sealed with a flexible sealing plug.

It is another feature of the invention, by virtue of its unique battery containment and access arrangement to locate battery electrical contacts, access means, and switch means in such a way as to (a) preclude snag-prone protuberances which otherwise might violate the curvilinear, dome-like shape of the exposed surfaces of the device and thus further reduce potential interference (snagging) on external objects which could cause injury to the user/wearer, and (b) provide an uninterrupted curvilinear, dome-like surface through which emitted light may be radiate in substantially all directions.

It is another object of the invention to provide the ability to activate, de-activate, change functions, and/or radiate user-defined emissions based on built-in sensing capabilities to include (a) barometric pressure sensors (e.g., altitude), and (b) accelerometers (e.g., motion or tilt angle).

It is another object of the invention to provide the ability to sense illumination and interrogation by remote RF or IR sources such as Identification Friend or Foe (IFF) devices, and to provide a pre-set, programmable coded response via its various emitters which will identify the wearer of the invention as a friendly force and thus avoid "friendly fire" casualty.

SUMMARY OF THE INVENTION

The general purpose of the present invention, which will be described subsequently in greater detail, is to provide a multi-mode, multi-function marker/signaling device for steady and flash-coded identification in the visible and/or infrared spectrum for any marking or identification purpose in low/no light conditions.

To attain this, the present invention comprises a cover having a first (main) switch means and second (nose) switch means cavity at opposing ends. A clear or translucent lens is integrally formed as a part of the cover. A base is secured to the cover by attachment means such as screws, ultrasonic welding, or sealing adhesives. An O-ring or other seal provides waterproofing and dustproofing for the space housing the electronics and captured between the cover and the base.

A electronic circuit board having a first switch board and a second switch board is mounted within the waterproof space defined by the cover and base. There is a first switch means mounted within the first (main) switch means cavity of the cover and a second switch means mounted within the second (nose) switch means cavity of the cover. The switch means are in electronic communication with the electronic circuit board.

A main electronic circuit board having a first switch circuit, and a second switch circuit board mounted within the waterproof space defined by the cover and base. There is a first switch means mounted within the first (main) switching means cavity of the cover and a second (nose) switch means mounted within the second (nose) switching means cavity of the cover. The two switch means are in electronic communication with the electronic circuit board via magnetic field effects on electronic reed switches.

A variety of light emitting diodes (LEDs) and/or infrared (IR) emitters are mounted on the electronic circuit board. The LEDs and emitters can be multi-colored, white, or infrared (IR). The switch means are capable of being set to different positions to interact with the programmable circuitry on the electronic circuit board in order to actuate a different combination of visible or infrared (IR) emissions, depending on the pre-programmed settings.

A primary (non-rechargeable) or secondary (rechargeable) battery provides the power source. A battery containment compartment comprises an integral part of the base with access to that compartment arrayed on the outside/bottom surface of the base which forms the surface by which the device is mounted to other equipment or structures. A battery sealing plug secures and protects the battery within the containment compartment.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1*a* is a front perspective view of the present invention and FIG. 1*b* is a rear perspective view of the present invention.

FIG. 2*a* is a side elevational view, FIG. 2*b* is a top plan view, FIG. 2*c* is a bottom plan view, FIG. 2*d* is a rear elevational view and FIG. 2*e* is a front elevational view of the present invention.

FIG. 3*a* is a front perspective view of an alternate embodiment of the present invention and FIG. 3*b* is a rear perspective view of an alternate embodiment of the present invention.

DETAILED DESCRIPTION OF THE INVENTION

Figure 4C:
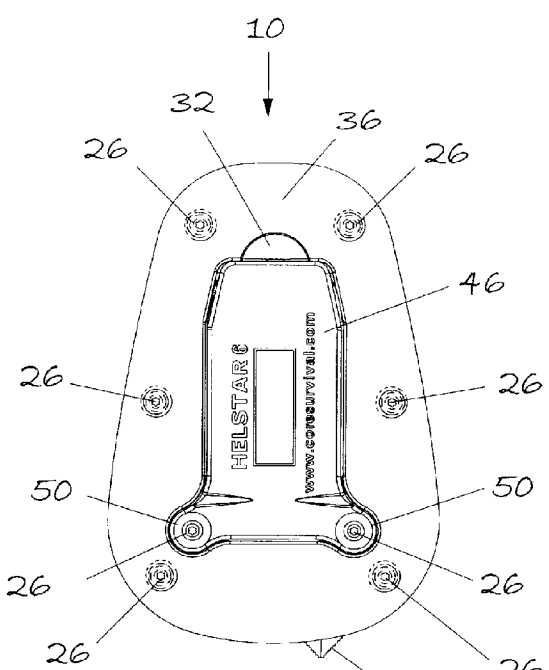
FIG. 4*c* is a bottom plan view.
Figure 4B:
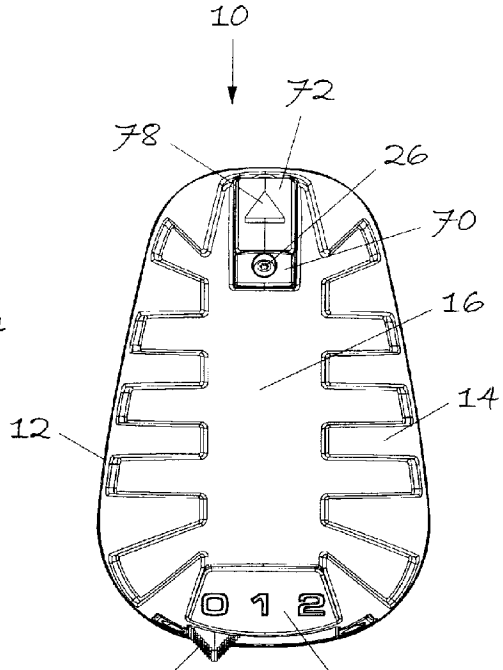
FIG. 4*b* is a top plan view.
Figure 4A:
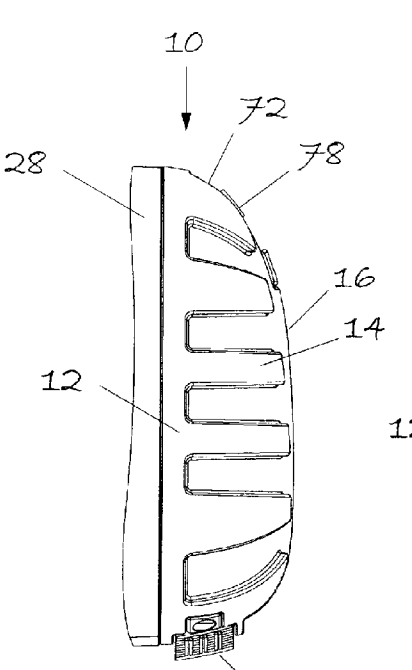
FIG. 4*a* is a side elevational view.
Figure 4E:
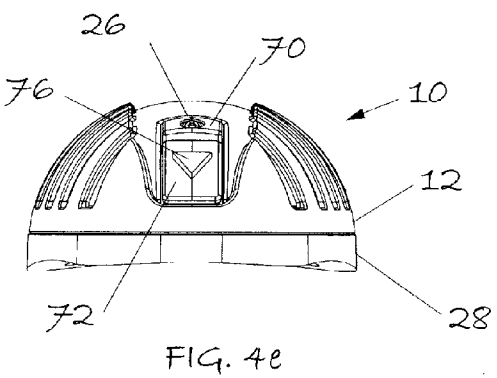
FIG. 4*d* is a rear elevational view and FIG. 4*e* is a front elevational view of an alternate embodiment of the present invention.
Figure 4D:
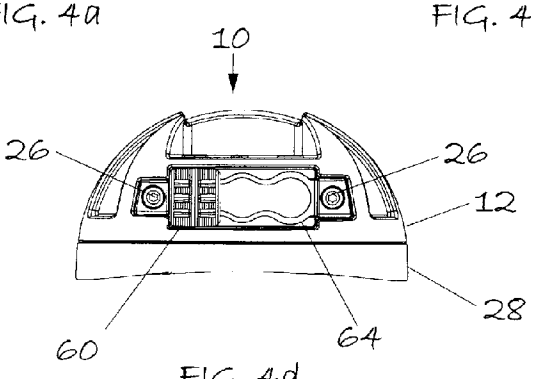
Figure 5:
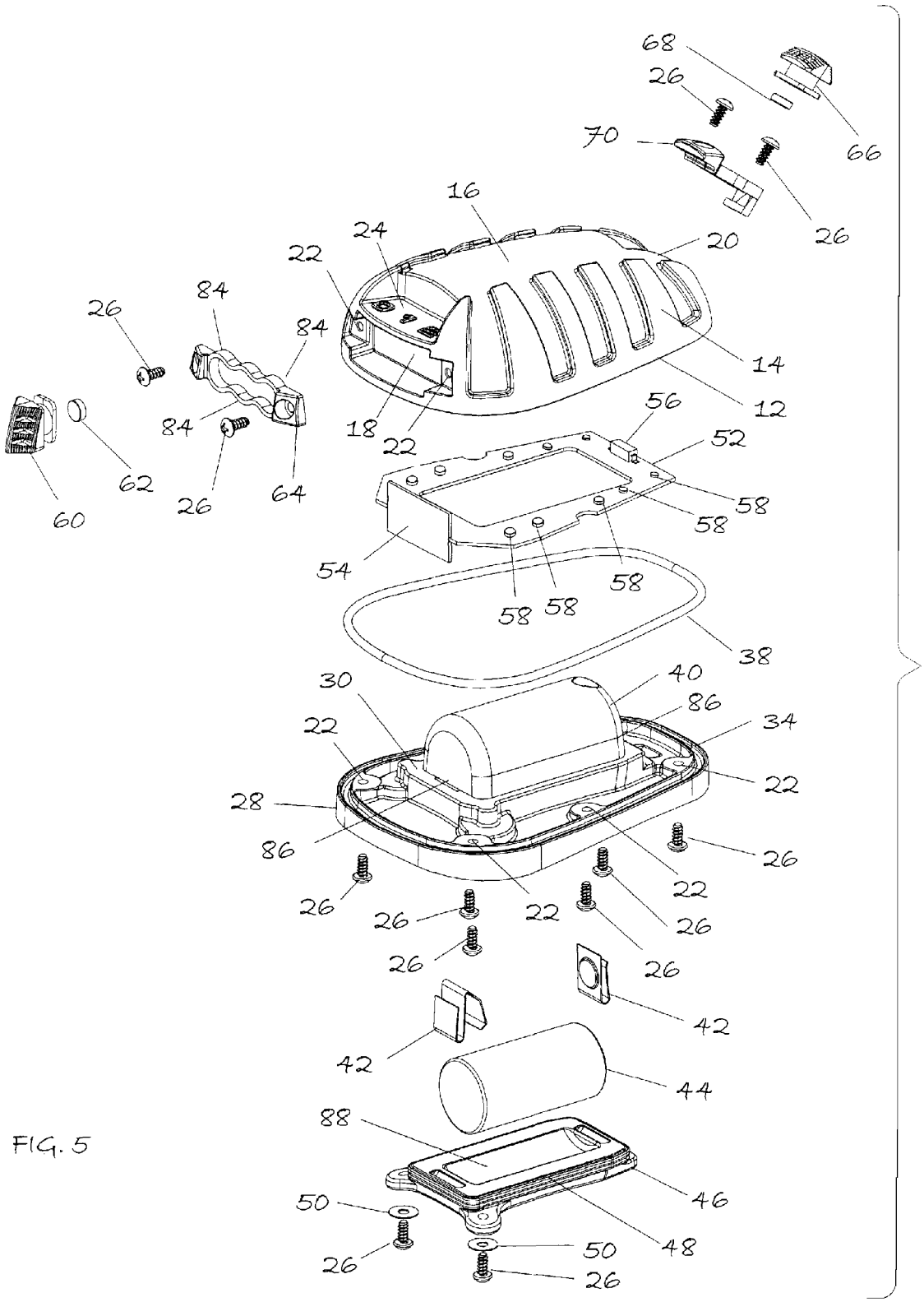
FIG. 5 is an exploded view of the present invention.
Figure 6:
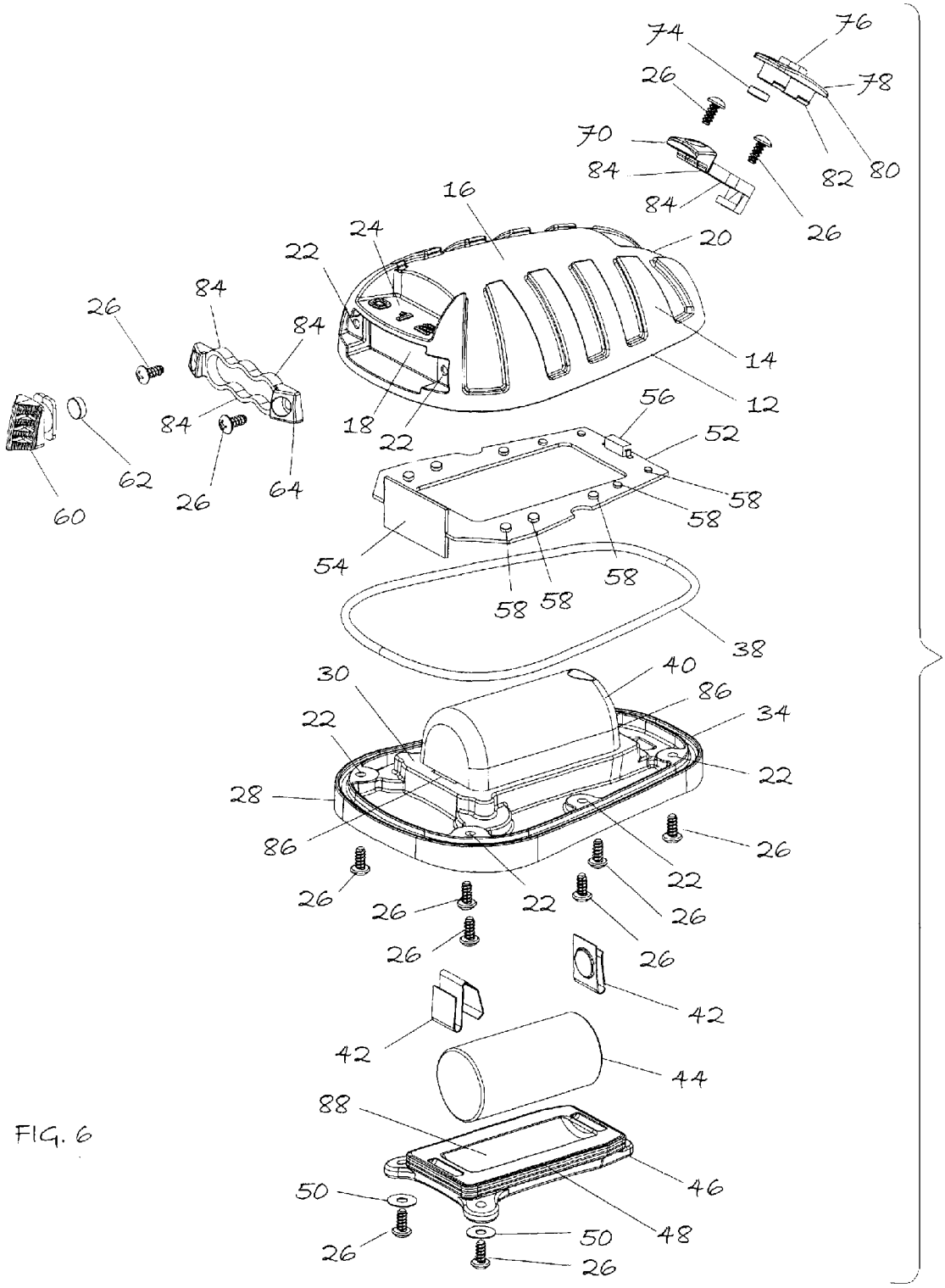
FIG. 6 is an exploded view of an alternate embodiment of the present invention.

Referring to the drawings FIGS. 1 to 7, generally, the present invention 10 will now be described in greater detail. A cover 12 is comprised of an outer surface portion 14 and a clear, tinted and/or translucent lens 16. The outer surface portion 14 has a first (main) switch means cavity 18 defined at a first end and a second (nose) switch means cavity 20 defined at an opposed second end. The cover 12 is generally dome-shaped in all cross sections and is of compact size. The conforming shape on all sides provides for minimal snag hazard to avoid personal injury during parachute operations and to provide an aerodynamic, low noise, low drag shape for the high speed free fall portion of some parachute operations. The outer surface portion 14 has bores 22 that are inwardly threaded juxtaposed the first (main) switch means cavity 18 and the second (nose) switch means cavity 20, respectively, and further has bores 22 extending through a bottom surface of the outer surface portion 14. An indentation with numerical indicia 24 affixed is defined at the first end of the cover 12. It is understood that the relative orientation of the first switch means and the second switch means may be perpendicular, as shown in the figures, or parallel.

Figure 7B:
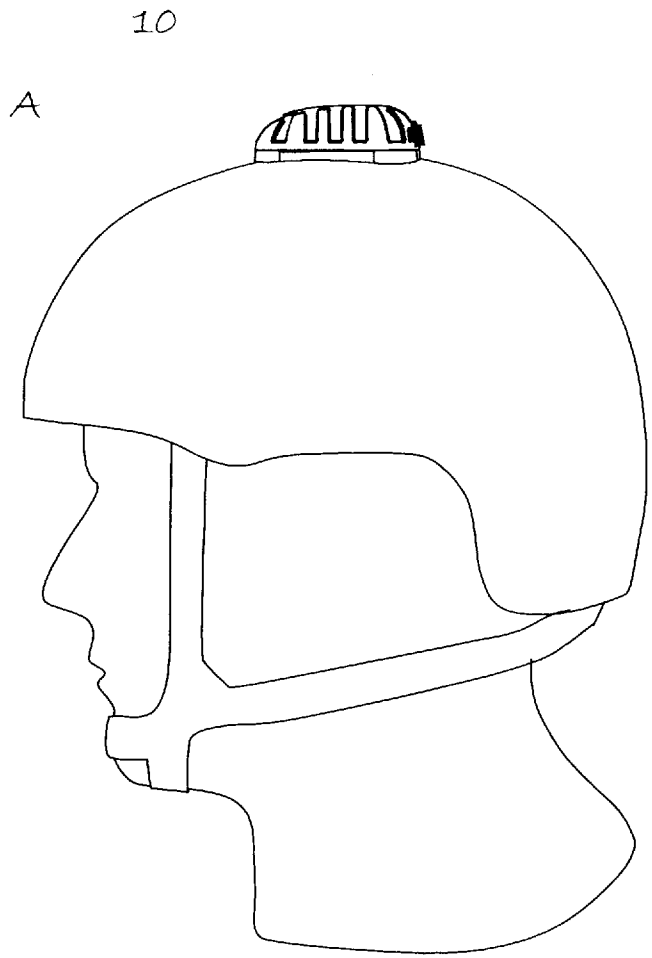
FIG. 7*b* is a view of the device in use attached to the top of a helmet.
Figure 7A:
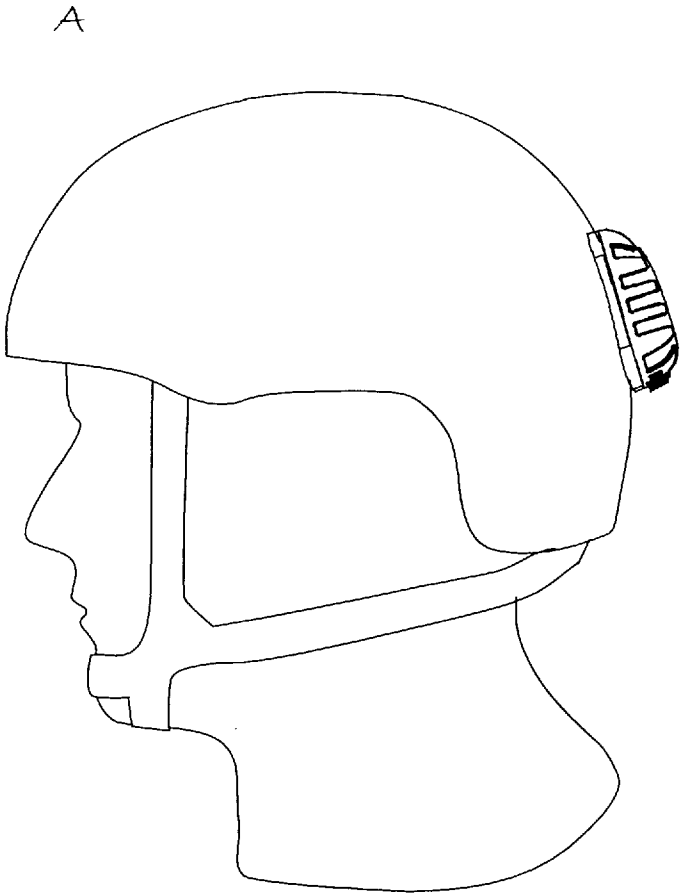
FIG. 7*a* is a view of the device in use attached to the back of a helmet.

A base 28 is comprised of an upper surface 30, a lower surface 32 with a passage defined therethrough, a perimeter edge 34 and having bores 22 that are inwardly threaded defined through the upper surface 30 and the lower surface 32. The base 28 is preferably arcuate in shape to conform to the configuration of headgear, such as a parachute helmet. However, the lower surface 28 may be flattened to mount on other surfaces. Fastening means 36, such as hook and loop material (Velcro®), is present on the lower surface 32 to secure the invention 10 to a helmet and the like. FIGS. 7*a* and 7*b* illustrate the invention 10 mounted on a helmet in two of several possible locations.

A seal 32, preferably formed of a flexible rubber or rubber-like material to provide hermetic sealing, is mounted to and extends around the top perimeter sealing and interface edge 34. The cover 12 is mounted on the base 28 and secured with attachment screws 26 extending through bores 22 in the outer surface portion 14 and the base 28, and further defining an open cavity.

A battery containment compartment 40 having an outer surface and an inner surface with an open cavity defined by the inner surface is integrally formed on the upper surface 30 of the base 28. The compartment 40 is of predetermined size to accept rechargeable or non-rechargeable batteries. Battery contacts 42 are affixed on the inner surface of the battery containment compartment 40 and in electrical communication with the electronic circuit board 52 through slots 86 at each end of the battery containment compartment. A battery 44 is a power source for the invention 10 and is encased within the battery containment compartment 40. Slots 86 translating between the inner and outer surface of the battery containment compartment 40 are provided for the installation of the battery contacts 42. The slots 86 are filled and covered with sealant to provide waterproof and dustproof sealing of the battery contacts 42 as installed in the slots 86.

Battery replacement is accomplished by opening a battery sealing plug 46 mounted to the lower surface 32 of the base 28 via attachment screws 26 with washers 50. The plug 46 is preferably molded of a flexible rubber or rubber-like material and has a flexible sealing surface 48 formed to sealably engage with the periphery of the outer edge of the battery containment compartment 40. The battery sealing plug 46 has a recess 88 formed therein to interface with the shape of the battery 44 to assist in retention and sealing. By placing battery replacement through the passage of the base 28, the battery 44 is secured within the mounting interface between the invention 10 and the structure, such as a helmet, upon which the invention 10 is mounted. This method of battery installation and replacement is novel in comparison to other helmet mounted devices. The sealing plug 46 provides hermetic sealing against air, moisture, and dust.

An electronic circuit board 52 comprising electronic components, sensors/receptors, circuits, a processor and a memory coupled to the processor is disposed on the upper surface 30 of the base 28 and positioned within and captured by the surfaces defining the open cavity of the cover 12 and the base 28. The electronic circuit board 52 is electronically coupled with the battery 44. The electronic circuit board 52 has a first (main) switch means circuit board portion 54 attached thereto and a second (nose) switch board portion 56. The electronic circuit board 52 provides multi-function, multi-color/radiation multi-mode features, and includes a built-in programmable integrated circuit (PIC). Steady illuminated and various flashing functions can be programmed with variable oscillation patterns, variable intensity, and variable sequencing to provide appropriate intensity/visual acuity and/or coded or information-contained pulses.

A sliding main switch 60 coupled with a small disc magnet 62 is mounted within a main switch retainer 64 defining a series of two or three split capture rings 84. The main switch 60 interacts with electronic reed switches (not shown) disposed within the cover 12, upon the main switch board 54. Electronic reed switches are well known and not described here. The sliding main switch 60 is in electronic communication with the main switch board 54. A mechanical detent is defined for each position of the sliding main switch 60 by the split capture rings 84. Thus an appropriate level of hoop stress is allowed to solidly capture the sliding main switch 60 in each split capture ring 84 and to provide an appropriate level of resistance when moving from one split capture ring 84 position to the other. The main switch retainer 64 is secured juxtaposed the first (main) switch means cavity 18 with attachment screws 26. The numerical indicia 24 affixed on the outer surface portion 14 are labeled "0," "1," and "2". The sliding main switch can be positioned in OFF (Function"0") and two selectable operating modes, labeled "1" and "2." The sliding main switch 60 can thus be ergonomically actuated by the user's thumb, in low/no light intensity situations, and in the same manner the ON/OFF status of the device and/or its precise operating function can be determined by tactile feel while the invention 10 is mounted on a helmet (as shown in FIGS. 7*a* and 7*b*).

A sliding nose switch 66 coupled with a build-in disc magnet 68 is mounted within a nose switch retainer 70. The retainer 70 is secured within the second (nose) switch means cavity 20 of the outer surface portion 14 with attachment screws 26. The magnet 68 interacts or fails to interact with an electronic reed switch (not shown) disposed within the cover 12 upon the electronic circuit board 52. The sliding nose switch 66 is in electronic communication with the nose switch circuit disposed on the circuit board 56. The sliding nose switch 66 provides the user the ability to select a unique third function ("Function 3") or one of two distinct operating modes: Mode A (such as overt or visible) or Mode B (such as covert or infrared), depending on the particular embodiment of the invention.

Alternatively, a nose switch/plug 72 replaces the sliding nose switch 66. The nose switch/plug 72 has an upper surface 78, a lower surface 80 to which are attached two downwardly depending flanged structures 82 which engage with split capture rings 84 of the nose switch retainer 70. The nose switch/plug 72 is reversible and repositionable, and mounts in and is secured by the nose switch retainer 70. The nose switch/plug 72 is coupled with an asymmetrically located magnet 74 located in one of the flanged structures 82 which interacts (or fails to interact) with an electric reed switch disposed upon the electronic circuit board within the cover 12. The interaction of the magnet 74 and reed switch provides for selection of a third function or alternate modes of operation depending on the particular embodiment of the invention. The nose switch/plug 72 has directional indicator indicia 76 shaped generally like an arrow affixed to the upper surface 78 to allow the user to orient the nose switch/plug 72 either UP or DOWN to provide visual and/or tactile cue as to a particular operating mode. The nose switch/plug 72 functions as a mode-of-operation selector. The user in the field has the ability to change from one set of two functions to another unique set of two functions without tools or programming by repositioning the nose switch/plug 72.

A plurality of emission sources 58 comprised of a variety of types and colors of LED and infrared emitters are disposed on the electronic circuit board 52 and are in electrical communication with the electronic circuit board 52. The features can be combined and/or manipulated in ways to provide two, three, four or more different user-defined and selectable functions. Multiple Red/Blue/Green (RGB) three-chip LEDs provide the ability to emit primary colors as well as a range of other colors as variations in a single light source 58. Multiple high-intensity "white" light LEDs are provided to meet FAA parachuting requirements at night and to provide for special mission requirements including emergency signaling ("strobe" effects). Multiple infrared (IR) emitters and/or LEDs are provided for covert operations.

Any of the emitter sources 58 can be operated at the same time individually or in tandem with other emitter sources, each in either flashing or steady ON. For example, in one operating mode four RGB light sources 58 are operating in constant Green/Steady while two high intensity white light sources 58 are operating intermittently in a flashing mode. Furthermore the electronic circuit board 52 can be programmed to allow the emitter sources 58 mounted at one end of the electronic circuit board 52 to be set in different color/intermittent/steady modes from the light sources 58 at the opposed end of the electronic circuit board 52.

The multi-function, multi-color/radiation, multi-mode features of the invention 10 are facilitated by a programmable integrated circuit (PIC). The steady ON and flashing functions can be programmed with variable oscillation patterns and peaks and sequencing to provide increased intensity/visual acuity and/or coded or information-containing pulses. The battery 44 outputs to the emitter sources 58 are controlled by the electronic circuit board 52 having programmable integrated circuits. Voltage regulator devices and/or circuits are added to the electronic circuit board 52 to match emitter input requirements and/or to achieve optimized output for specific mission requirements.

There are four general model configurations of the device. In the first two configurations the nose switch/plug 72 and the sliding main switch 60 are in use. In the first configuration the nose switch/plug 72 is fixed in one position with the integral direction indicator 76 oriented up and the sliding main switch 60 can be set to OFF (position "0") or ON (position "1" or "2"). Thus, two functions are available. In the second configuration, four functions are available. The nose switch/plug 72 can be selected in either Mode A (direction indicator 76 up) or Mode B (direction indicator 76 down). The mode of the nose switch/plug 72 is changed by the user removing the nose switch/plug 72, rotating the nose switch/plug 180° and reinstalling. The directional indicator 76 marks Mode A or Mode B selection by either an up or down direction. The main switch 60 is either set at OFF or ON position. The physical separation between the operating modes created by the two different installation positions of the nose switch/plug 72 prevents the possibility of inadvertent visual emissions in a mode of operation that has not be pre-selected by the nose switch/plug 72.

The third general configuration incorporates the sliding main switch 60 and the sliding nose switch 66. There are three variable, user-defined functions within one mode of operation. The sliding main switch 60 is either in the OFF position ("0"), or ON (position"1" or "2"). The sliding nose switch 66 provides a third operating function by being moved from its OFF (down) position to its ON (up) position. The movement of the sliding nose switch 66 to its ON position can be programmed to override the functionality of the sliding main switch 60 completely, no matter what position the sliding main switch 60 is in. In such case, movement of the sliding nose switch 66 back to its OFF position returns the functionality of the sliding main switch 60 to the operating function defined by its current position, and electronically locks-out and prevents the reactivation of the ON function of the sliding nose switch 66 until both the sliding main switch 60 and the sliding nose switch 66 are resent to their respective OFF positions.

The fourth general configuration incorporates the sliding main switch 60 and the sliding nose switch 66 and provides a minimum of four functions total. There are a total of two modes of operation (Mode A and Mode B), with a minimum of two functions in each mode. The sliding main switch 60 is either in the OFF ("0") or ON ("1" or "2") position. The sliding nose switch 66 can be either in Mode A or Mode B. Furthermore, the electronic circuit board of the device has the ability to re-program the function or mode of operation by cycling the main switch through a pre-established pattern of movements among main switch positions "0," "1," or "2." The integral programmable integrated circuit (PIC) would detect these switch movements as powering ON and OFF through a preprogrammed code which, when detected by the PIC, would initiate a routine which would result in a change to a function or an operating mode. Not only would the user of the device have the ability to reprogram while in the field, but would also have a secure coded barrier between visible and covert operating modes.

The device 10 has vibratory means (e.g., a small electric motor with an eccentric rotating mass) in electrical communication with the electronic circuit board 52, known to those skilled in the art, which provides vibratory feedback as a check of the status of the battery 44. This battery status check and corresponding vibratory feedback from the device to the user/wearer every time the device 10 is activated and/or moved from one function to another, or whenever the battery contact is broken and re-made as when a battery is first installed, or temporarily removed and re-installed specifically to conduct a battery status check. Activation of the device or the change from one function to another or whenever fresh battery contact is made by installing a battery would actuate a programmed routine through a circuit separate from the lighting circuit whereby a voltage test of the battery under load is conducted against an on-board electronic reference such as a Zener diode. If the battery is at a voltage level associated with an acceptable level of remaining capacity, a predetermined vibratory pattern (e.g. three buzzes) would occur. If a depleted level of battery voltage (i.e., capacity) is detected, then a different pattern of vibratory signals (e.g., two buzzes) would be sent to show a lower state of battery readiness. At some predetermined battery voltage (capacity) level, the vibratory feedback (e.g., one or no buzzes) would alert the user that the battery 44 must be replaced.

The electronic components disposed within the cover 12 and base 34 and upon the electronic circuit board 52 and the nose switch board 54 are protected by the ring seal 38 or other sealing method such as ultrasonic welding to prevent moisture and dust intrusion. If attachment is made by mechanical means such as screws 26, they would be installed with either O-rings or other compounds with sealant qualities.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

We claim:

1. A mountable multi-function light device, comprising in combination:

a cover having an outer surface portion and a lens, and further having a first switch means cavity defined at a first end and a second switch means cavity defined at an opposed second end;

a base having an upper surface, a lower surface with a passage defined therethrough, a top perimeter edge and fastening means affixed to the lower surface;

a electronic circuit board;

a main switch coupled with a disc magnet mounted within the first switch means cavity of the first end wall of the cover and being in electrical communication with the electronic circuit board;

a main switch retainer having integral capture and detent means, being secured with attachment screws juxtaposed the first switch means cavity defined at the first end of the cover, and whereby the main switch coupled with the magnet is mounted within the retainer;

a nose switch coupled with a disc magnet mounted within the second switch means cavity defined in the second end wall of the cover and being in electrical communication with the electronic circuit board;

at least one emitter source mounted on the electronic circuit board and being in electrical communication with the electronic circuit board;

a battery being in communication with the electronic circuit;

a battery containment compartment mounted on the base; and battery compartment sealing means adaptable to seal and secure the battery within the battery containment compartment.

2. The system as set forth in claim 1, further comprising a nose switch retainer having integral capture and detent means, being secured with attachment screws juxtaposed the second switch means cavity defined at the second end of the cover, and whereby the nose switch coupled with the magnet is mounted within the retainer.

3. The device as set forth in claim 2, whereby at least one emitter source produces visible and infrared emissions, in steady and intermittent/flashing mode.

4. The device as set forth in claim 3, whereby the electronic circuit board comprises a main switch portion and a nose switch portion.

5. The device as set forth in claim 4, whereby the emitter sources are light emitting diodes.

6. The device as set forth in claim 4, whereby the emitter sources are infrared emitters.

7. The device as set forth in claim 6, whereby the main switch retainer has a first integral capture and detent means, a second integral capture and detent means and a third integral capture and detent means, and further whereby the positioning of the main switch in the first integral capture and detent means actuates a first function of the system for a selected operating mode and the positioning of the main switch in either the second integral capture and detent means or third integral capture and detent means actuates a second function of the system for a selected operating mode.

8. The device as set forth in claim 1, further comprising vibratory feedback means configured to provide a predetermined vibratory pattern indicating the relative state of battery capacity.

9. A mountable multi-function light device, comprising in combination:

a cover having an outer surface portion and a lens, and further having a first switch means cavity defined at a first end and a second switch means cavity defined at an opposed second end;

a base having an upper surface, a lower surface with a passage defined therethrough, a top perimeter edge and fastening means affixed to the lower surface;

a electronic circuit board;

a main switch coupled with a disc magnet mounted within the first switch means cavity of the first end wall of the cover and being in electrical communication with the electronic circuit board;

a main switch retainer having integral capture and detent means, being secured with attachment screws juxtaposed the first switch means cavity defined at the first end of the cover, and whereby the main switch coupled with the magnet is mounted within the retainer;

a repositionable nose switch/plug coupled with an asymmetrically positioned magnet mounted within the second means switch cavity defined in the second end wall of the cover and being in electrical communication with the electronic circuit board;

at least one emitter source mounted on the electronic circuit board and being in electrical communication with the electronic circuit board;

a battery being in communication with the electronic circuit board;

a battery containment compartment mounted on the base; and battery compartment sealing means adaptable to secure the battery within the battery containment compartment.

* * * * *